United States Patent [19]

Hohenberger et al.

[11] 4,010,993

[45] Mar. 8, 1977

[54] ELECTRICAL CONNECTOR DEVICE

[75] Inventors: Reiner Mathias Hohenberger, Brackenheim; Gerd Johann Emil Holst, Loewenstein, both of Germany

[73] Assignee: Bunker Ramo Corporation, Oak Brook, Ill.

[22] Filed: Feb. 28, 1975

[21] Appl. No.: 554,331

Related U.S. Application Data

[63] Continuation of Ser. No. 410,059, Oct. 26, 1973, abandoned, which is a continuation of Ser. No. 333,553, Feb. 20, 1973, abandoned, which is a continuation of Ser. No. 142,876, May 13, 1971, abandoned.

[52] U.S. Cl. ..... 339/31 R; 339/217 S

[51] Int. Cl.[2] ..... H01R 27/00

[58] Field of Search ..... 339/217 R, 217 S, 256 R, 339/258 R, 258 A, 31 R, 31 M, 31 T, 32 R, 32 M, 33

[56] References Cited

UNITED STATES PATENTS

| | | | |
|---|---|---|---|
| 2,689,337 | 9/1954 | Burtt et al. | 339/217 S |
| 2,716,737 | 8/1955 | Maberry | 339/31 R |
| 2,979,689 | 4/1961 | Jackson et al. | 339/217 S |
| 3,047,832 | 7/1962 | Deakin | 339/217 S |
| 3,059,213 | 10/1962 | Lalonde | 339/217 S |
| 3,396,364 | 8/1968 | Bonhomme | 339/217 S |
| 3,449,708 | 6/1969 | Lawrence et al. | 339/217 S |
| 3,475,720 | 10/1969 | Culver | 339/217 S |
| 3,495,205 | 2/1970 | Ricci | 339/31 M X |
| 3,571,784 | 3/1971 | Naus et al. | 339/217 S |
| 3,641,483 | 2/1972 | Bonhomme | 339/217 S |

FOREIGN PATENTS OR APPLICATIONS

| | | | |
|---|---|---|---|
| 918,994 | 2/1963 | United Kingdom | 339/31 R |

*Primary Examiner*—Joseph H. McGlynn
*Attorney, Agent, or Firm*—William Lohff; F. M. Arbuckle

[57] ABSTRACT

This invention provides a device for connecting electrical conductors, portions of which can be used as both a receptacle and as a mating connector for joining conductors of an electrical circuit. The device has an insulating body with a passageway extending therethrough from a front end to a rear end. An electrically conductive sleeve is inserted into the passageway, wherein the sleeve is locked and held by abutments formed in the passageway. The sleeve has a resilient electrical contact and serves as a female contact, receiving a mating male contact member. Alternatively the support end of a connector element can be inserted into the sleeve, converting it into a male contact which can be inserted into an insulating body identical to the firstmentioned insulating body to form a plug-type electrical connector. Attachment means, such as a soldering sleeve, is provided on one end of the sleeve for connecting the sleeve to an electrical circuit. An opening is provided in the body so that a tool can be used to withdraw the sleeve from the insulating body in order to replace the sleeve and/or male contact element.

5 Claims, 3 Drawing Figures

ELECTRICAL CONNECTOR DEVICE

This is a continuation of application Ser. No. 410,059, filed OCt. 26, 1973; abandoned, which is a continuation of application Ser. No.: 333,553 filed Feb. 20, 1973 abandoned, which is a continuation of application Ser. No. 142,876, filed May 13, 1971 abandoned.

BACKGROUND OF THE INVENTION

1. Field of the Invention

This invention relates to the field of connectors for electrical conductors, particularly connectors of the plug-type utilizing connecting elements such as contacting posts, knife contacts, or pin contacts, which are inserted into a mating receptacle.

2. Description of the Prior Art

Present plug-type electrical connectors have sleeves and pin-type connector elements which are locked into corresponding insulation bodies by forming a chamber in a body having walls which embrace the respective sleeve or connector element and form-locks it into the body. The chamber in the receptacle body must be fabricated to hold the receptacles and the chamber in the rating plug connector body must be fabricated differently to hold the plug connector element which has a configuration different from the configuration of the sleeve held in the receptacle body. Therefore, fabrication of the receptacle body and the mating plug connector body requires separate manufacturing steps using different tools. Special tools are also required for fabricating the sleeves and the connecting plugs. The cost of manufacturing connectors to the prior art are high, since separate operations and separate tools are required to produce the body of the receptacles and the body of the mating plug connectors. Storage and inventory costs are also high, since separate receptacle bodies and mating connector plug bodies must be stocked, increasing the total number of pieces in inventory.

SUMMARY OF THE INVENTION

An object of the present invention is to provide a new electrical connector which is easily produced.

A further object of the present invention is to provide an electrical connector which is more economical to manufacture, to assemble, and to maintain in inventory than electrical connector of the prior art. This objective is not by providing a body of insulating material having a passageway which is adapted to hold a sleeve of electrically conductive material therein. The one-piece sleeve integrally formed has resilient means extending outward towards the insulation body. The resilient means engages with stop means in the passageway of the body to hold the sleeve in the body. The sleeve also has contact means on its inner surface to provide electrical contact for a mating connector member. In this manner, the device of the invention performs the function of a female contact.

In accordance with this invention, insulation bodies having passageways with identical configurations are used to provide the bodies for both the female and the corresponding male types of electrical connectors. The male contact element (pole, post, knife contact, or pin contact) can be economically fabricated with low material costs being a simple turned part or stamped part. The rearward portion of the male contact element is inserted into the sleeve where it is held in place by the engagement of a recess on the male contact element with a resilient inward projection on the sleeve. The male contact element can therefore be easily centered in the sleeve with which it is held in good electrical contact, by utilizing relatively simple tools and little effort.

The sleeve and male contact element sub-assembly can then be inserted into the rear of the passageway in the insulation body, whereby the resilient means extending outward from the sleeve in deflected inward during insertion, and then snaps outwardly to automatically lock the sleeve in the insulation body by engaging with an abutment in the passageway. This automatic locking of the sleeve in the insulation body provides a method of quickly mounting the male contact element without requiring tools or special skills. In a preferred embodiment of the electrical connector device, the sleeve is secured against rotation within the insulation body by the provision of an outwardly projecting lug on the sleeve which engages with abutment in the passageway.

The sleeve may be provided with a soldering extension for soldering the sleeve to a conductor of an electric circuit. The soldering extension provided on the sleeve can be fabricated so that a male contact element received by the sleeve may be soldered into its supporting sleeve at the same time the sleeve is being soldered to an outside electrical circuit. To aid in accomplishing a reliable soldering joint, the male contact element may be provided with a prolongation extending rearwardly into the soldering extension of the sleeve.

DESCRIPTION OF THE PREFERRED EMBODIMENT

Figure 1:
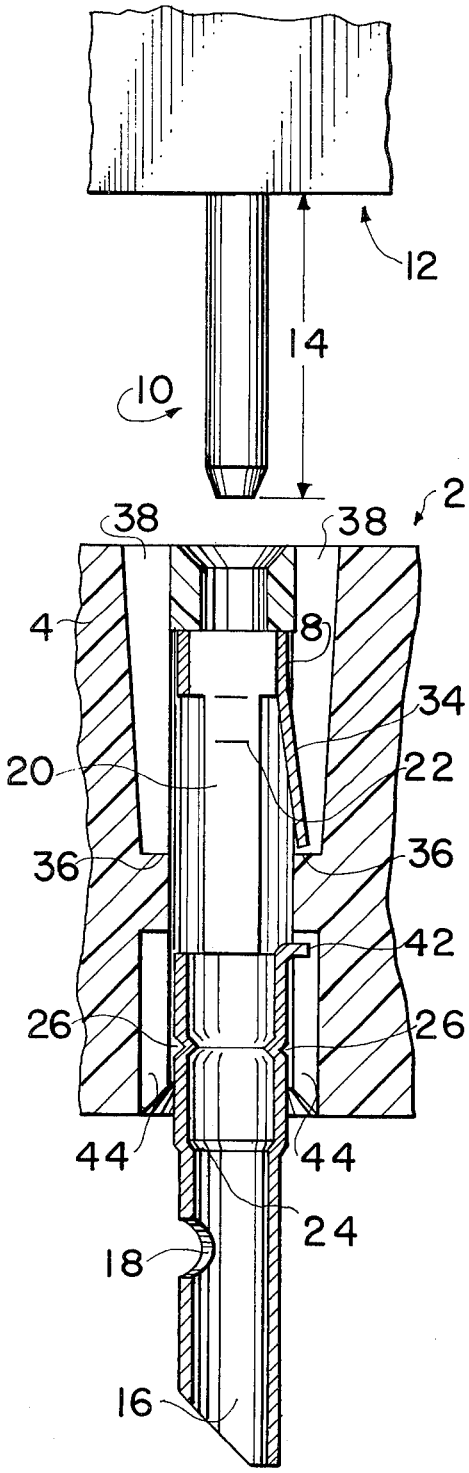
FIG. 1 shows a cross-section of the device of this invention functioning as a receptacle, and a mating plug-type connector poised for insertion into the receptacle.

FIG. 1 shows a receptacle 2 having a body 4 made of insulating material, such as a synthetic material, with a passageway 6 supporting sleeve 8. The sleeve is made of electrically conducting contact material such as nickeled, chromed, silvered, or gilded brass. A male contact member 10 (pole, post, pin, knife contact, or pin contact) of an electrically conducting contact material of a mating connector can be inserted from a front end into the sleeve 8 to make electrical contact within the plug-in length 14. The sleeve 8 has an integral soldering sleeve 16 on the rear end which is axially parallel to the passageway, the soldering sleeve being connectable with an external conductor (not shown) and having an inspection window 18 for visually inspecting the soldered connection.

The sleeve 8 has two resiliently formed contact arms 20 connecting the front end of the sleeve and the back end of the sleeve. These contact arms are bonded or distorted inwardly as shown at 32 in a position to resiliently contact and grip male contact element 10. Solder is prevented from flowing into the front end of the sleeve by an obstruction 24 (such as a cap or bolt) which is located between the plug-in portion of the sleeve 8 and the soldering sleeve 16, and is connected securely against sliding by means of snap slots 26 formed in sleeve 8.

Figure 2:
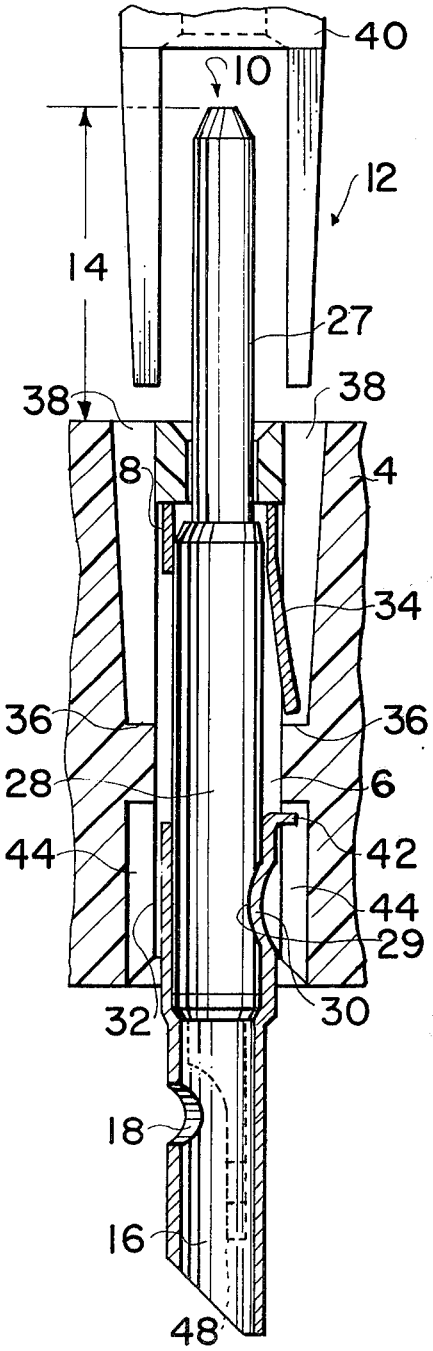
FIG. 2 shows a cross-section of the device substantially as shown in FIG. 1 with a male contact element inserted therein, and a tool suitable for removing the sleeve from the insulating body.

The mating connector 12, which is shown schematically in FIG. 1 may be of known configuration on may be a modified form of the male connector device of FIG. 1 such conversion to modified form being shown in cross-section in FIG. 2. The plug-type connector 12 is produced by merely inserting a male contact element 10 into sleeve 8 as shown in FIG. 2. The larger rear portion 28 of the male contact element is inserted into the sleeve 8 where it is held by means of a recess 29 in the male contact element 10 mating with a resilient inward projection 30 on the sleeve which is rearward disposed from contact arms 20. The element 10 is thereby prevented from sliding or rotating in the sleeve, and is in firm electrical contact with this sleeve. The smaller front portion 27 of the connector element 10 extends beyond the front end of the body 4.

In a preferred embodiment of the connector device, the passageway 6 extends to the rear of the insulation body with a relatively uniform diameter forming a passageway aperture 32 at the rear side of the insulation body sleeves. The male 8 with the male contact element 10 assembled therein are then slidably inserted through the passage aperture 32 into an assembled position within the insulation body 4. In the assembled position, the projecting end 27 of the male contact element 10 extends beyond the front end of the insulation body by a distance equal to the plug in length 14. In this position, the male contact element is locked into the sleeve by means of the recess and inward projection 30, and the sleeve is locked in the passageway 6 of the body 4 by means of at least one tongue 34 extending elastically from the outer wall of the sleeve into engagement with abutment is formed in the passageway 6. In a preferred embodiment the frontwardly facing abutment 36 is the termination of an opening 38 which is provided for insertion of a tool 40 which will be described later in greater detail.

In the assembled position, the sleeve 8 with the male contact element 10 fixedly contained therein is secured against rotation in the passageway 6 by the provision of at least one lug 42 projecting into the passage aperture 32 of the insulation body 4. In the embodiment shown in FIG. 2, two groove 44 separated from each other by 180° are formed in the passage aperture 32 of the insulation body 4. Likewise, the pair of openings 38 having abutments 36 are separated from each other by 180°, so that the sleeve 8 is lockable in the insulation body 4 in two possible positions which are 180° apart.

The sleeve 8 containing the male contact element 10 can be replaced (for example to replace a burned-off or otherwise damaged connector element) by using tool 40. The tool 40 is inserted from the end of the insulation body 4 into the openings 38 to move the tongue 34 back into resilient alignment with the outer wall of the sleeve. The sleeve 8 containing a pin 10 may then be withdrawn through the passage aperture 32 in the rear of the insulation body. The tool is equally effective, of course. In removing the sleeve alone as shown in FIG. 1.

Figure 3:
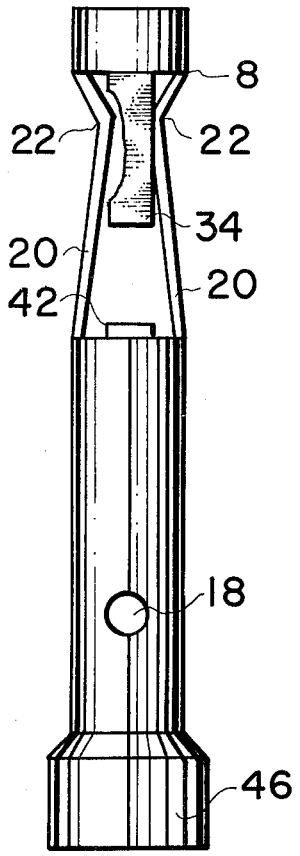
FIG. 3 shows an alternate embodiment of a sleeve.

This invention is not limited to the embodiment shown in the drawings, since other embodiments are possible within the scope of the claims. For example. the attachment means 16 can be constructed as a wire wrap or soldering pin, or as a closed or slotted snap sleeve 46 with an inspection opening 18 as shown in FIG. 3. In another embodiment, the sleeve 8, rather than being produced from resilient contact material, could be constructed rigidly with contact arms made of contact material attached to one or both sides, and having a loaf spring attached to the outer wall of the sleeve to form the arresting tongue 34. The contact element for use with a rigid sleeve would have to be resilient construction. For example, it may be slotted, or it may have at least one contact arm attached on one side made of resilient material. The manufacturing costs of a contact element 10 could be reduced by constructing it with a uniform cross-section over the entire length except for the extreme forward end. Additionally, the attachment means could be provided by the prolongation piece 48 of the connector element 10 as indicated by the dotted lines in FIG. 2 rather than being formed on the sleeve 8. The prolongation piece 48 may be long enough to project out of the connecting means 16, or it may be shorter than attachment means 16 as shown in FIG. 2. The prolongation place 48 may be offset, flattened, round, transversely perforated, or axially bored as required to facilitate its connection with another conducting element.

Thus, various modifications and changes are contemplated and may obviously be reasons to without departing from the spirit and scope of the invention as hereinafter defined by the appended claims.

The embodiments of the invention in which an exclusive property or privilege is claimed are defined as follows:

1. An electrical connector device which may be used either as a female connector device or as a male connector device, said electrical connector device comprising:

a body of insulating material having a passageway extending from a front end to a rear end and including an outwardly formed stop means between said ends; and a one-piece metallic sleeve located at least partially within said passageway and having outwardly extending resilient means cooperating with said stop means for positioning said sleeve in said passageway, the sleeve having front and rear end portions and contact means interconnecting said end portions, said contact means bowed inwardly to resiliently contact a projecting end portion of a first male contact element of a mating connector when such element is inserted into said sleeve in a direction from the front end of said passageway toward the rear end thereof with said contact means then acting as a female connector device, and said contact means also being outwardly expandible to alternatively engage and support an enlarged rear portion of a second male contact element constituting an adapter converting said sleeve from a female contact to a male contact when the combination of said sleeve and said second male contact element is inserted in said passageway in the opposite direction from the rear end thereof toward the front end thereof, said contact means receiving the second male contact element in a position where the smaller front portion of said second male contact element then extends outwardly from said body beyond the front end of said passageway, the sleeve including attachement means on said rear end portion for making electrical connection to an external conductor.

2. The device as claimed in claim 1 wherein said sleeve has an outwardly projecting lug and said body has a groove receiving and engaging said lug to prevent rotation of said sleeve in said body.

3. The device as claimed in claim 1, wherein said body includes an opening communicating with said resilient means, whereby a tool can be inserted into said opening to elastically disengage said resilient means from said stop means to withdraw said sleeve from said passageway.

4. An electrical connector device adapted for use as a female connector device or a male connector device, said electrical connector device comprising a body of insulating material having a plurality of passageways extending therethrough from a front end to a rear end, with outwardly formed stop means between said ends in each of said passageways, metallic sleeves located in at least some of said passageways, said sleeve having outwardly extending resilient means cooperating with said stop means for positioning said sleeves in said passageways, each sleeve having front and rear end portions and contact means interconnecting said end portions, said contact means bowed inwardly to resiliently contact a projecting end portion of a first male contact element of a mating connector when said element is inserted into said sleeve in a direction from the front end of said passageway toward the rear end thereof so that said metallic sleeve constitutes a female connector device, the sleeve including attachment means on said rear end portion extending outwardly from said body for making electrical connection to an external conductor, and adapter means in at least one of said sleeves converting said sleeve from a female contact to a male contact, said adapter means comprising a male contact element having a rear portion engaged and supported by said contact means, and a smaller front portion extending outwardly from said body beyond the front end of the passageway in which said at least one of said sleeves is positioned.

5. The device as claimed in claim 4, wherein said body has additional stop means adjacent said front end abutting against said sleeve, and stopping said sleeve and the rear portion of said male contact element from moving towards said front end.

* * * * *

UNITED STATES PATENT OFFICE

CERTIFICATE OF CORRECTION

PATENT NO. : 4,010,993

DATED : March 8, 1977

INVENTOR(S) : Reiner Mathias Hohenberger & Gerd Johann Emil Holst

It is certified that error appears in the above-identified patent and that said Letters Patent are hereby corrected as shown below:

On the first page, the background data should include a heading "Foreign Application Priority Data" and "West German Serial No. P 20 26 386.9 filed on May 29, 1970" below that heading.

Signed and Sealed this

*Twentieth* Day of *September 1977*

[SEAL]

*Attest:*

RUTH C. MASON
*Attesting Officer*

LUTRELLE F. PARKER
*Acting Commissioner of Patents and Trademarks*